US005888051A

United States Patent [19]

McLoughlin et al.

[11] Patent Number: 5,888,051

[45] Date of Patent: Mar. 30, 1999

[54] PUMP PRESSURE CONTROL SYSTEM

[76] Inventors: John E. McLoughlin, 26 Southern Blvd., Nesconset, N.Y. 11767; Neocles G. Athanasiades, 6 Maybeck Dr., East Setauket, N.Y. 11733

[21] Appl. No.: 692,598

[22] Filed: Aug. 6, 1996

Related U.S. Application Data

[63] Continuation-in-part of Ser. No. 286,336, Aug. 5, 1994, abandoned.

[51] Int. Cl.[6] ..... F04B 49/00

[52] U.S. Cl. ..... 417/53; 417/26; 417/34; 417/307

[58] Field of Search ..... 417/34, 212, 213, 417/307, 364, 26–31, 53, 44.2; 137/115.13, 487.5

[56] References Cited

U.S. PATENT DOCUMENTS

| | | | |
|---|---|---|---|
| 3,544,235 | 12/1970 | Smith | 417/34 |
| 3,786,869 | 1/1974 | McLoughlin | 417/34 |
| 3,981,618 | 9/1976 | Nelson, Jr. | 417/34 |
| 4,047,665 | 9/1977 | Moynihan | 417/22 |
| 4,111,223 | 9/1978 | Gelnett | 137/115 |
| 4,189,005 | 2/1980 | McLoughlin | 169/24 |
| 4,492,525 | 1/1985 | Bilyeu | 417/34 |
| 4,545,740 | 10/1985 | Nishikiori et al. | 417/317 |
| 4,550,747 | 11/1985 | Woodworth et al. | 137/487.5 |
| 4,911,468 | 3/1990 | Fukunaga | 280/707 |
| 5,067,654 | 11/1991 | Paige | 417/307 |

FOREIGN PATENT DOCUMENTS

| | | | |
|---|---|---|---|
| 0149010 | 7/1985 | European Pat. Off. | 137/115 |
| 1274402 | 8/1968 | Germany | 417/34 |
| 1403276 | 10/1968 | Germany | 417/34 |

*Primary Examiner*—Ayaz R. Skeikh
*Assistant Examiner*—Xuan M. Thai
*Attorney, Agent, or Firm*—Louise S. Heim

[57] ABSTRACT

A system for controlling the pressure output of an engine-driven centrifugal fire pump includes a discharge pressure sensor mounted in the discharge line of the pump. A governor varies the RPM of the engine in response to pressure changes detected by the discharge pressure sensor. An electronically controlled hydraulic relief valve responsive to the discharge pressure sensor operates simultaneously with the governor to provide improved pressure control in overpressure situations.

2 Claims, 4 Drawing Sheets

PUMP PRESSURE CONTROL SYSTEM

CROSS-REFERENCE TO THE RELATED APPLICATION

This application is a continuation-in-part of U.S. patent application Ser. No. 286,336, filed Aug. 5, 1994 now abandoned.

BACKGROUND

1. Field of the Invention

This invention relates to the art of firefighting equipment.

More particularly, the invention relates to a system for controlling the pressure output of a fire pump.

In a further and more specific aspect, the instant invention concerns an electronically operated system for controlling the pressure output of an engine-driven fire pump.

2. Description of the Prior Art

Controlling the discharge pressure of an engine-driven fire pump mounted on a fire truck is vital. The pump must supply water at a continuous rate and steady pressure so that firemen operating hand nozzles at a fire scene can control the reaction force generated by their nozzles. This is no simple matter, however, since even slight variations in pressure in the supply line leading to the intake of the pump are amplified by the pump on the discharge side, causing surges or oscillations in the water flow discharge at the nozzle and corresponding changes in the reaction forces. Such changes are extremely dangerous, as they can pull a nozzle out of a fireman's grip, or even throw him off a ladder or a ledge.

The simplest prior art device for controlling the pressure output of a fire pump is a mechanical relief valve which opens to discharge excess water when the incoming pressure is higher than the desired output pressure. A shortcoming of such a valve, however, is that, because the relief point must be manually set, it requires the use of a human operator, and can not be used with robotically controlled equipment of the type which is increasingly being used at high-intensity, high-risk fires. Furthermore, the relief valve only functions to dissipate excess incoming pressure, and has no utility in situations where the incoming pressure is too low, such as when the water source is being depleted or another hose is connected to the system. In addition, if the pump engine continues to operate at full speed after the relief valve is opened, water will be continuously dumped from the system, resulting in needless waste, as well as flooding of the area where the fire truck is located.

More recently, electronically operated pressure control systems have been introduced. Two such systems are disclosed in U.S. Pat. Nos. 3,786,869 and 4,189,005 to McLoughlin, the subject matter of which is herein incorporated by reference. In these systems, the desired output pressure is dialed in or otherwise transmitted to a control box on board the fire truck, where it is compared to the actual output pressure as measured by a transducer. Any difference between the desired and actual output pressures is converted to an electrical signal which is fed to a DC motor which increases or decreases the RPM of the centrifugal pump as needed until the desired output pressure is reached. A shortcoming of this type of system is that, because the response time of the servo-mechanism controlling the engine is slow, much time can pass before the appropriate RPM and correct discharge pressure are reached. This is especially troublesome during transient events, such as overpressure spikes, where the system's response time is greater than the length of the event. Furthermore, no allowance is made for situations such as when the engine is already at idle and the incoming pressure suddenly increases, or is higher than desired, such as can happen when the pump is connected to a hydrant.

Another pressure control system of interest is disclosed in German Patent No. 1,274,402 to Muller & Co., which discloses an engine-driven pump which responds to an overpressure in the supply line by simultaneously opening a pressure relief valve and mechanically reducing the engine speed. The shortcomings of this purely mechanical system are that by its nature, in cases of overpressure, the relief valve will always be open to some extent, allowing some fluid to always bypass the relief valve, and the engine RPM will always be above its ideal setting to a certain extent.

Accordingly, a need exists for a new and improved electronically operated fire pump discharge pressure control system for quickly and safely responding to drops or increases in the incoming pressure of a fire pump, which change the discharge pressure required, as well as changes in discharge pressure due to the opening or shutting of various valves downstream of the pump.

SUMMARY OF THE INVENTION

Briefly, to achieve the desired objects of the instant invention in accordance with the preferred embodiments thereof, a system is provided for completely controlling the pressure output of an engine-driven fire pump. The discharge pressure of the pump is obtained using a pressure sensor on the discharge side. The system controls the discharge pressure of the pump by controlling the engine RPM. Raising the RPM raises the pressure and lowering the RPM lowers the pressure. This control is achieved via the throttle motor (carburetor control/ fuel rack for diesel engines) or by direct control of the electronic control module in the case of electronically controlled engines.

In cases where the pressure is higher than the desired set point pressure, the system will lower the engine RPM and simultaneously control a pressure relief valve which may be commanded to open and dump water for short durations to relieve overpressure spikes, or for longer duration to relieve excess water coming into the pump. The opening and closing points of the relief valve are automatically and dynamically set by the microprocessor with no manual input. These points are dependent on the desired set point pressure. As the discharge pressure begins to rise above the set point, the RPM is commanded to decrease at a variable rate. The relief valve starts opening when the pressure typically exceeds the set point by 20 psi (this value can be changed). As the overpressure drops below 20 psi, the valve opening is arrested. As the pressure approaches the set point the relief valve is commanded to start closing and at the same time, the same rate at which the RPM is commanded to decrease is continuously adjusted by the microprocessor in order to maintain the discharge pressure at close to the set point value.

The relief valve is in the form of a piston, the lower surface of which rests against a valve seat formed in a passage leading between the discharge side of the pump and a relief passage leading to a storage tank and/or atmosphere. The upper surface of the piston forms the bottom wall of a chamber joined to an auxiliary passage also leading from the discharge side of the pump. A first, normally open, solenoid valve is located in the auxiliary passage upstream of the relief valve, and a second, normally closed, solenoid valve is located in the auxiliary passage downstream of the relief valve. When the solenoid valves are in these positions, the relief valve remains shut. If the pressure sensor detects that the discharge pressure is too high, the microprocessor sends a signal to close the first solenoid valve and open the second solenoid valve, thereby increasing the pressure against the bottom end of the relief valve piston, forcing it open and allowing the excess water to be discharged via the relief passage. At the same time, a signal is sent to continuously lower the engine RPM under program control. As the pressure approaches the desired level, the first solenoid opens, thus closing the relief valve.

BRIEF DESCRIPTION OF THE DRAWINGS

The foregoing and further and more specific objects and advantages of the instant invention will become readily apparent to those skilled in the art from the following detailed description of preferred embodiments thereof taken in conjunction with the drawings in which.

DETAILED DESCRIPTION OF THE PREFERRED EMBODIMENT

Figure 1:
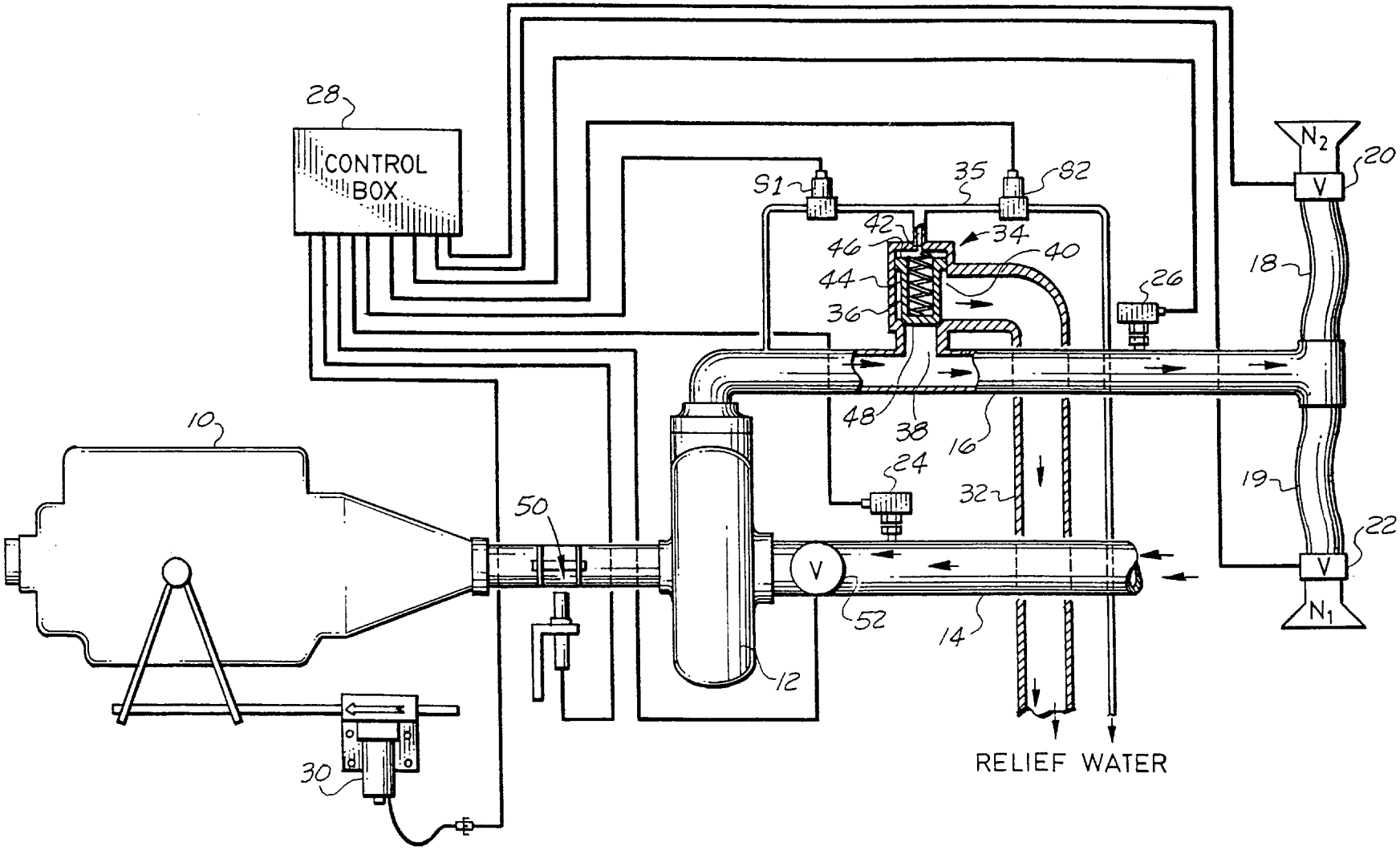
FIG. 1 is a schematic drawing of the pressure control system according to the present invention.

Turning now to the drawings in which like reference characters indicate corresponding elements throughout the several views, attention is first directed to FIG. 1, which shows a schematic diagram of the nozzle pressure control system. A gasoline or diesel engine 10 is mechanically coupled to a centrifugal pump 12 having an intake line 14 leading to a source of liquid such as a fire hydrant, and a discharge line 16. For the sake of convenience, the discharge line 16 is shown here as being coupled to a pair of hoses 18, 19, each having its own nozzle N1, N2 and control valve 20, 22, but it may equally well be connected to a single hose or many hoses.

A discharge pressure sensor 26 is mounted on the discharge line 16 downstream of the pump 12. The pressure sensor 26 may be of any type commercially available, such as a Bourdon type potentiometer, semi-conductor transducer, or strain gauge type transducer. The output of the pressure sensor 26 is fed into a control box or microprocessor 28, which may either communicate directly with the interface on an electronically controlled engine or with the servo-mechanism which controls the throttle 30 on a diesel engine to vary the RPM of the engine as needed to reach the desired pressure output.

There are certain situations where the incoming pressure may be so high that the speed of the engine 10 can not be reduced quickly enough to prevent excessive discharge pressure, or where the engine 10 may already be at idle and thus can not be slowed any further. To allow for such situations, a relief passage 32 is provided for dumping any excess liquid. The relief passage 32 preferably leads to an open storage tank (not shown) on the firefighting vehicle. Once the storage tank is filled, the excess liquid simply spills over the top of the tank to atmosphere. Flow through the relief passage 32, which communicates with the discharge line 16 at a location between the pump 12 and the discharge pressure sensor 26, is controlled by a hydraulic relief valve 34. A secondary relief passage 35 having an inlet located between the pump 12 and the relief passage 32 also dumps to the storage tank and/or atmosphere.

The hydraulic relief valve 34 comprises a valve chamber 36 having a first port 38 opening into the discharge line 16, a second port 40 opening into the relief passage 32, and a third port 42 communicating with the secondary relief passage 35. A piston 44 is disposed for reciprocation in the valve chamber 36. The top surface 46 of the piston 44, which faces the third port 42, has a larger cross sectional area than the bottom surface 48 of the piston 44, which faces the first port 38. Thus, when the pressures on both sides of the piston 44 are equal, the piston 44 remains in a closed position, blocking the first and second ports 38, 40 so that there is no flow into the relief passage 32. When the pressure on the bottom surface of the piston 44 increases beyond a certain level, the piston 44 moves away from the first port 38, allowing flow into the relief passage 32.

The pressure at which the relief valve 34 opens to dump excess liquid is determined by a pair of solenoid valves S1, S2 which are located in the secondary relief passage 35 upstream and downstream, respectively, of the relief valve 34. The upstream solenoid valve S1 is normally open and the downstream solenoid valve S2 is normally closed. Thus, the pressure on the top surface 46 of the piston 44 is normally equal to the pressure on the bottom surface 48 of the piston 44. The system is programmed so that when the pump discharge pressure as measured by the discharge pressure sensor 26 exceeds the desired output pressure by a set amount, say 20 psi, the upstream solenoid valve S1 closes and the downstream solenoid valve S2 opens, causing the pressure on the top surface 46 of the piston 44 to decrease, and the relief valve 34 to open, and continue opening, allowing excess liquid into the relief passage 32. The relief valve 34 continues to open until the discharge pressure sensor 26 detects that the output pressure is within a given range—say 5 psi—above the set point, at which point a signal is sent to close the downstream solenoid valve S2, causing the relief valve 34 to remain in its current position. As the pressure approaches the set point, a signal is sent to reopen the upstream solenoid valve S1 and close the relief valve 34.

Simultaneously, while the relief valve 34 closes, the controller 28 continuously monitors and adjusts the RPM of the engine to an appropriate level which will prevent a dangerous secondary pressure surge from occurring when the relief valve is completely closed. The relief valve will be totally closed when the discharge pressure approaches the set point, leaving the RPM control portion of the controller to maintain the pressure until another overpressure event occurs. The precise coordination of the operation of the RPM control system and the relief valve control system eliminates the possibility of unstable pressure oscillations which would otherwise occur due to masking effects that the operation of either of these systems would have on the other.

Various other features may also be included in the system. For instance, an RPM sensor 50 may provided for monitoring the engine speed. If the sensor 50 detects that the engine speed is approaching a preset value (maximum safe RPM), the microprocessor 28 will prevent the engine from speeding up any farther. In such cases, the desired pressure output may not be reached, but the output will be as close as possible to the desired level without overspeeding the engine.

An intake transducer may be provided on the pump inlet to monitor intake pressure and allow even more precise control system decisions.

An in-line valve 52 may be incorporated into the pump feed line for providing still greater control of the system pressure. The position of the in-line valve 52 can be controlled by the microprocessor 28 over the full range of pressures.

An alarm or alarms may also be provided to provide warnings when various problems occur, such as water shortages, high temperatures or the like. The alarm or alarms may be either visual, in the form of warning lights on a control panel, audible, or tactile. A tactile alarm would cause the flow within a hose to modulate so that a nozzle operator would feel the hose shaking and thus be aware of a problem.

The system may also include a pump temperature sensor which sends a signal to the microprocessor 28 when a maximum safe temperature is reached, as may happen when the pump is operating with all discharge lines shut so that no water flows through the system. Then microprocessor 28 then outputs a signal to a pump-to-tank valve to discharge high temperature water until a safe temperature is reached.

Figure 2:
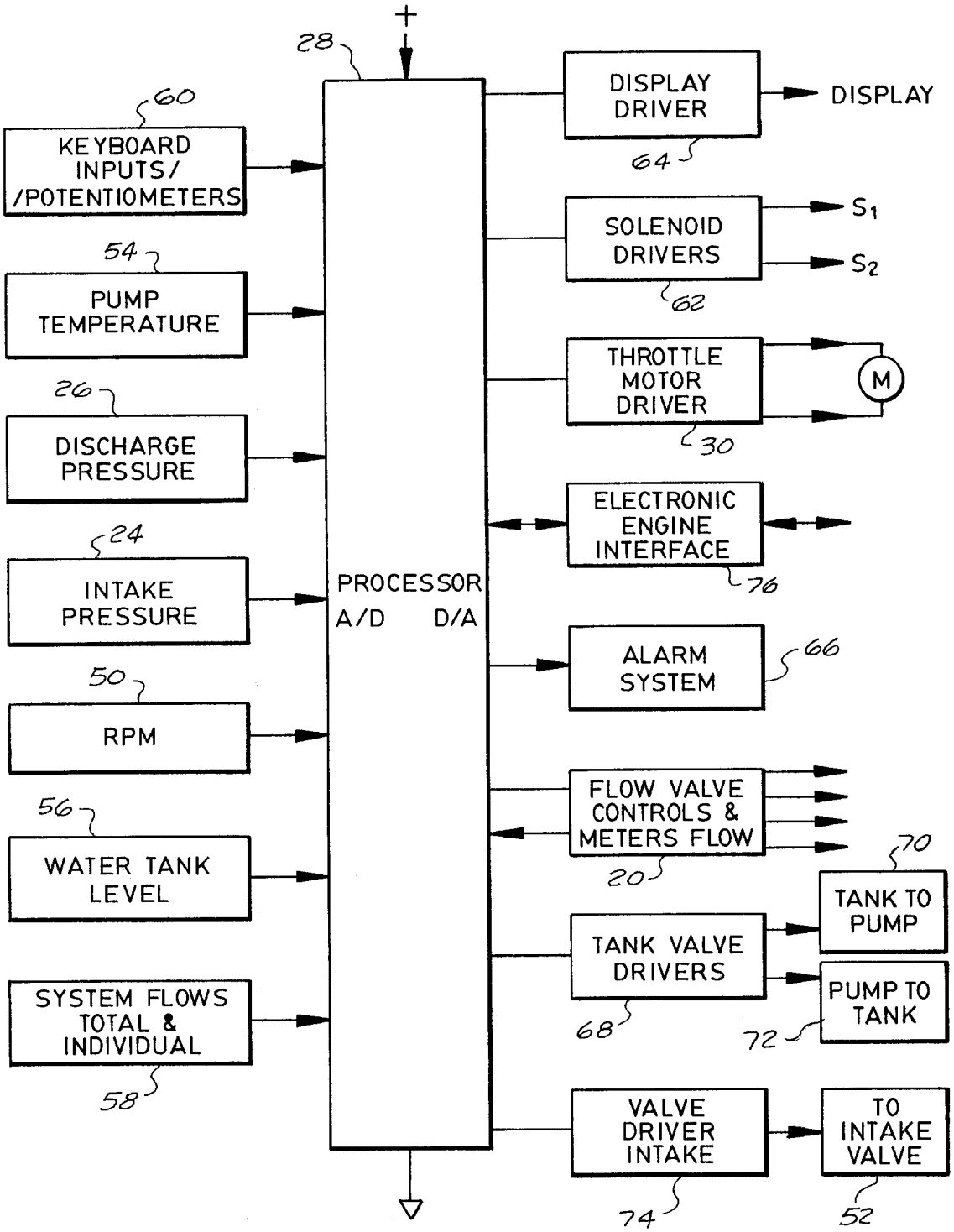
FIG. 2 is a control block diagram of the system.

FIG. 2 shows a diagram indicating the inputs and outputs of the microprocessor 28. Inputs to the microprocessor 28 include discharge pressure as sensed by the discharge pressure sensor 26 and engine speed as sensed by the RPM sensor 50. Other inputs include pump temperature 54, water tank level 56, individual and total flow rates 58, and keyboard/potentiometer inputs 60. One output of the microprocessor 28 drives the throttle motor 30. Another output 62 is to drive the solenoid valves S1 and S2. Other outputs are to a display driver 64, the alarm system 66, the flow valves 20, 22, tank valve drivers 68 for driving a tank-to-pump valve 70 and a pump-to-tank valve 72, and another valve driver 74 for the in-line valve 52. Further inputs could also be received from and further outputs sent to the interface 76 of an electronic engine.

Figure 5:
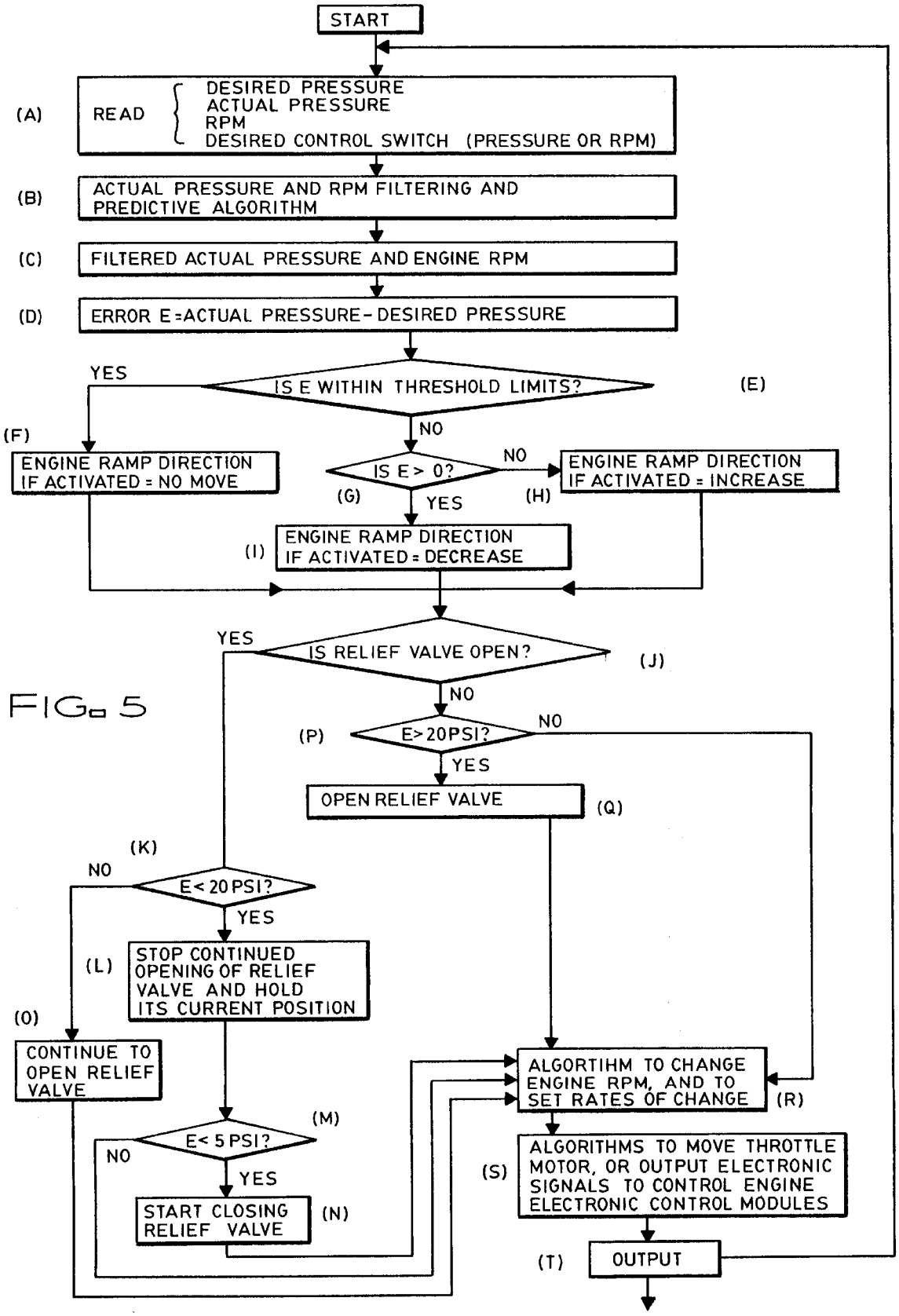
FIG. 5 is a flow diagram depicting the operation of the digital logic of the pressure control system of FIG. 1.

The software control algorithm and program is stored in the microprocessor 28. Operation of the program is best described with reference to FIG. 5.

Initially, the microprocessor 28 reads the desired pressure $P_D$ as input from the keyboard 60, the actual pressure as measured by the discharge pressure sensor 36, the engine speed as measured by the RPM sensor 50, and a control switch determining whether the system is to operate in pressure control mode or RPM control mode. For the purposes of this disclosure, it will be heretofore assumed that the system is in pressure control mode, since RPM control mode takes effect only during those relatively rare occasions when the engine is in danger of overspeeding.

Statements B and C in the flow chart are steps for filtering the actual discharge pressure and engine speed as read by the discharge pressure sensor 36 and the RPM sensor 50, respectively. The filtering process allows the system to essentially ignore transient fluctuations in the discharge pressure or engine speed, and only to react to significant changes which outlast the response time of the system. Statement D is a step for determining the error E, or discrepancy between the desired discharge pressure $P_D$ and the filtered actual pressure $P_A$.

Decision E is a step for determining whether the error E falls within a specified allowable range. If it is determined that E is within the allowable range, then the engine speed isk held constant by setting the ramp value to 0 or NO MOVE, as shown at step F. If the error E falls outside the range, the system moves on to decision G, to determine whether E is below the range (i.e. negative) or above the range (i.e. positive. If E is positive, then the filtered actual pressure is too high, and the engine ramp direction is set to DECREASE, as shown in step I. If E is negative, then the filtered actual pressure is too low, and the engine ramp direction is set to INCREASE, as shown in step H.

After appropriate action is taken with respect to the engine ramp direction, the system moves on to decision J, representing a step for determining whether or not the relief valve 34 is open. If the relief valve is closed, and the error E is determined at step P to exceed a preset upper value, then the relief valve $\Delta P_1$ (e.g. 20 PSI) 34 begins to open, as shown at step Q. If, on the other hand, the relief valve is already open and the error E is determined at step K not to exceed the upper value, then the relief valve 34 is prevented from opening any further, as shown at step L. If the error E at step M falls below a preset lower value $\Delta P_2$ (e.g. 5 PSI), the relief valve then begins to close as shown at step N.

Once the appropriate position of the relief valve 34 has been determined via steps J–Q, the system performs at steps R and S the algorithms for changing the RPM of the engine, and finally recycles to start. These algorithms will vary depending on the exact make and model of the engines.

Figure 3:
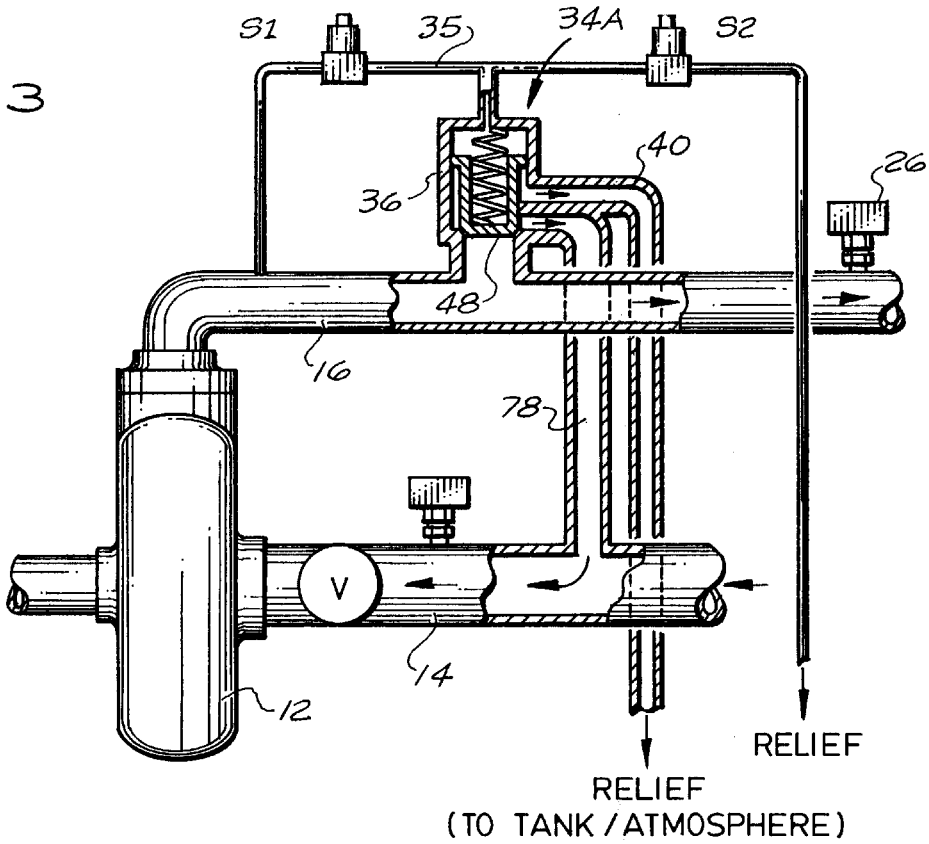
FIG. 3 is a schematic drawing of an alternative relief valve arrangement according to an alternate embodiment of the invention.

FIG. 3 shows a schematic diagram of an alternate relief valve arrangement 34A. The system is substantially the same as in the first embodiment, except that in addition to the relief passage 40 leading to atmosphere, a return line 78 leading to the pump intake line 14 is coupled to the discharge side of the valve chamber 36. The return line 78 is located closer to the bottom surface 48 of the piston 44, so that excess liquid is recirculated to the pump 12 before being dumped to the storage tank or atmosphere. This arrangement conserves water since it allows water to be returned to the pump whenever there is sufficient supply, and only dumps water to atmosphere as a last resort.

Figure 4:
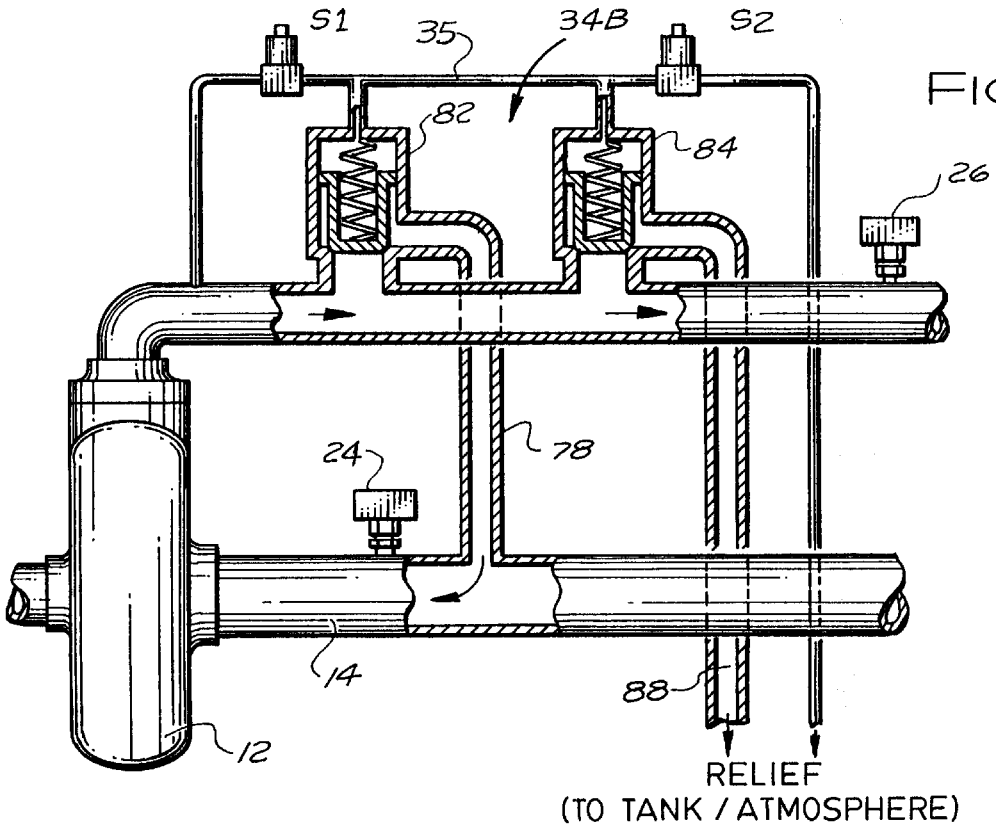
FIG. 4 is a schematic drawing of an another alternative relief valve arrangement according to another embodiment of the invention.

FIG. 4 is a schematic diagram of another alternative relief valve arrangement 34B. The principle of this arrangement is the same as in the previous arrangement 34A, except that instead of a single relief valve having a split discharge, two relief valves 82, 84 are provided. A first pair of solenoids S1, S2 is provided for controlling the operation of the first relief valve 82, and a second pair of solenoids S3, S4 is provided for controlling the operation of the second relief valve 84. The return line 78 leading from the first relief valve 82 leads to the intake line 14, while the discharge line 88 leading from the second relief valve 84, which is downstream of the first relief valve 82, dumps to the storage tank or atmosphere.

Various modifications and variations to the embodiments herein, chosen for purposes of illustration will readily occur to those skilled in the art. To the extent that such variations and modifications do not depart from the spirit of the invention, they are intended to be included within the scope thereof which is assessed only by a fair interpretation of the following claims.

Having fully described and disclosed the instant invention and alternately preferred embodiments thereof in such clear and concise terms as to enable those skilled in the art to understand and practice the same, the invention claimed is:

1. A method for controlling the discharge pressure of an engine-driven centrifugal pump in a system including the pump, an intake line coupled to the pump for receiving a liquid, a discharge line coupled to the pump for discharging the liquid, a discharge pressure sensor in the discharge line, for producing a first electronic signal proportional to the actual discharge pressure PA of the pump, an over pressure relief valve in the discharge line, the overpressure relief valve being movable in a first direction away from a fully closed initial position, and a second direction toward the fully closed initial position, and electronic control means electrically connected to the engine, the discharge pressure sensor and the overpressure relief valve, for varying the speed, the rate of change of speed, and ramp direction of engine, the method comprising the steps of:

a) selecting a desired discharge pressure $P_D$ for the pump, a valve opening pressure $P_O=P_D+\Delta P_1$, a valve closing pressure $P_C=P_D+\Delta P_2$ where $P_D<P_C<P_O$, and a minimum desirable pressure $P_{LOW}=P_D-\Delta P_3$;

b) electronically comparing the first electronic signal to a second electronic signal proportional to $P_D$, and calculating an error $E=P_A-P_D$ proportional to a difference between the first and second electronic signals;

c) actuating the electronic control means to set the engine ramp in a direction dependent on the sign and magnitude of E;

d) beginning to move the overpressure relief valve in the first direction, if closed, when $E>\Delta P_1$, and continuing to move the overpressure relief valve in the first direction until $E<\Delta P_1$;

e) stopping movement of the overpressure relief valve in the first direction, if moving in the first direction, and holding the valve's position as long as $\Delta P_2<E<\Delta P_1$;

f) beginning to move the overpressure relief valve in the second direction, if open, when $E<P_C$, and continuing to move the overpressure valve in the second direction as long as $0<E<P_C$;

g) actuating the electronic control means to continuously adjust the rate of change in engine speed in the set direction, wherein the rate is calculated to maintain $P_{LOW}<P_A<P_O$ without experiencing uncontrolled oscillations; and h) continuously repeating steps b–g.

2. The method according to claim 1, wherein the step of actuating the control means to adjust the rate of change in engine speed occurs simultaneously with movement of the valve.

* * * * *